US005315075A

United States Patent [19]

Junginger et al.

[11] Patent Number: 5,315,075

[45] Date of Patent: May 24, 1994

[54] EXHAUST GAS MUFFLER FOR AN INTERNAL COMBUSTION ENGINE

[75] Inventors: Wolfgang Junginger; Matthias Rösler, both of Waiblingen; Thomas Rupp, Berglen, all of Fed. Rep. of Germany

[73] Assignee: Andreas Stihl, Waiblingen, Fed. Rep. of Germany

[21] Appl. No.: 301,549

[22] Filed: Jan. 26, 1989

[30] Foreign Application Priority Data

Oct. 1, 1988 [DE] Fed. Rep. of Germany ... 8812435[U]

[51] Int. Cl.[5] ..... F01N 1/06

[52] U.S. Cl. ..... 181/240; 181/230; 181/239; 181/264; 181/282

[58] Field of Search ..... 181/230, 239, 240, 264, 181/282; 60/317

[56] References Cited

U.S. PATENT DOCUMENTS

| | | | |
|---|---|---|---|
| 2,975,854 | 3/1961 | Bakke et al. | 181/240 X |
| 3,404,749 | 10/1968 | Miller et al. | 181/240 |
| 3,798,769 | 3/1974 | Bailey | 181/240 X |
| 4,142,607 | 3/1979 | Lundwehr et al. | 181/240 X |
| 4,231,321 | 11/1980 | Mathner et al. | 181/240 X |
| 4,370,855 | 1/1983 | Tuggle | 60/317 |

*Primary Examiner*—Benjamin R. Fuller
*Attorney, Agent, or Firm*—Walter Ottesen

[57] ABSTRACT

The invention is directed to an exhaust gas muffler for an internal combustion engine such as a two-stroke engine for portable handheld tools such as a motor-driven chain saw. The engine includes a cylinder and a piston conjointly defining a combustion chamber wherein combustion gases are generated and discharged as a flow of exhaust gas during operation of the engine. The exhaust gas muffler includes a housing having a shell-like wall defining a chamber for receiving the exhaust gas from the engine. The housing has a primary outlet opening formed in the wall of the housing for passing a primary component flow of the exhaust gas out of the chamber in a first direction. The housing has a secondary outlet opening formed in the wall thereof for passing a secondary component flow of the exhaust gas out of the chamber in a second direction. A guide is provided at the secondary outlet opening for directing the secondary component flow toward and into the primary component flow to break up the latter and cause the same to become turbulent and mix with the cooler ambient air.

14 Claims, 3 Drawing Sheets

EXHAUST GAS MUFFLER FOR AN INTERNAL COMBUSTION ENGINE

FIELD OF THE INVENTION

The invention relates to an exhaust gas muffler for an internal combustion engine such as a two-stroke engine for a handheld portable tool such as a motor-driven chain saw and the like. The exhaust gas muffler essentially includes two housing shells which conjointly define an exhaust gas chamber. One of the housing shells has a primary outlet opening from which the exhaust gas flows in the direction of a primary exit vector.

BACKGROUND OF THE INVENTION

Such exhaust gas mufflers have elements in their exhaust gas chambers for deflecting and guiding the exhaust gas flow. The manufacturing effort connected therewith leads to corresponding manufacturing costs. However, this expensive configuration of the exhaust gas muffler can not be avoided since a guidance of the exhaust gas flow is achieved through these measures which prevent an annoyance or endangerment of the operator. In order to counteract especially the danger of fire as it exists, for example, with work connected with the use of motor-driven chain saws in the forest, it is required that the exhaust gas flow does not exceed a maximum permissible temperature in a specific measurement plane relative to the handheld portable tool.

SUMMARY OF THE INVENTION

It is an object of the invention to improve an exhaust gas muffler for internal combustion engines of the kind described above so that with a simple configuration, the temperature of the exhaust gas flow in a predetermined measurement plane is reduced.

The exhaust gas muffler of the invention is for an internal combustion engine such as a two-stroke engine for portable handheld tools such as motor-driven chain saws. The engine includes a cylinder and piston conjointly defining a combustion chamber wherein combustion gases are generated and discharged as a flow of exhaust gas during operation of the engine. The exhaust gas muffler includes: a housing having a shell-like wall defining a chamber for receiving the exhaust gas from the engine; the housing having a primary outlet opening formed in the wall for passing a primary component flow of the exhaust gas out of the chamber in a first direction; the housing having a secondary outlet opening formed in the wall for passing a secondary component flow of the exhaust gas out of the chamber; the secondary outlet opening being disposed adjacent the primary outlet opening; and, guide means disposed at the secondary outlet opening for guiding the secondary component flow to flow in a second direction transverse to the first direction thereby causing the secondary component flow to break up the primary component flow and mix that latter with the ambient air.

With the exhaust gas muffler according to the invention, the component flows of the flow of exhaust gas are so guided that the primary exhaust gas flow and the secondary exhaust gas flow intersect whereby the primary exhaust gas flow is broken up by the secondary gas flow and is thereby made intensely turbulent. This intense turbulence produces a reduction of the flow speed in the primary flow direction and effects an intensive mixing with cool ambient air whereby a distinctly more intense temperature reduction along the exhaust gas flow is obtained. As a consequence of this action, the temperature at the predetermined measuring plane is significantly reduced.

The guide member advantageously comprises a cap extending over the secondary outlet opening. The cap is provided with an end open in the direction toward the primary outlet opening. With this arrangement, the primary and secondary exhaust gas flows are conducted such that their vectors cross over and this cross-over is advantageously at an angle of approximately 90°. With the collision of the primary and secondary flows, the secondary flow causes a very considerable break-up of the primary flow and generates an intense turbulence by means of which cooler ambient air becomes mixed into the exiting exhaust gas flow.

According to another feature of the invention, a third opening defines a flow vector which lies approximately transverse to the secondary outlet opening. A further component exhaust gas flow exits through this third outlet opening. This third component exhaust gas flow strikes the primary exhaust gas flow in the flow direction of the primary flow after the secondary flow and effects a further turbulence and mixing of the primary exhaust gas flow with the ambient air after the latter has already been broken up and made turbulent by the secondary exhaust gas flow.

According to a preferred embodiment of the invention, the secondary outlet opening and its guide member are formed by a gill-like opening pressed from the material of the housing shell. This configuration is very easily realizable with manufacturing tools and since the effort of machine forming is relatively minimal, the material of the housing shell is only slightly stressed in the deformed region. The angle which the gill-like opening defines with reference to the casing of the housing shell determines the vector of the secondary exhaust gas flow and preferably amounts to approximately 45°.

The guide member can also be advantageously configured as a tubular piece inserted into the secondary outlet opening. Its longitudinal axis is then preferably at an angle of approximately 45° to the primary exit vector.

In order to break up and make turbulent the primary exhaust gas flow in an adequate amount, the secondary gas flow is adjusted to be approximately as large as the primary exhaust gas flow. Fort his purpose, the primary and secondary outlet openings have approximately the same through-pass cross section for the exhaust gas.

The cap is provided as a guide member and an advantageous configuration of the cap for the second outlet opening comprises that the cap is formed by means of a pressing of the housing shell. This pressing has the shape of a spherical segment and has a cut edge on its side facing toward the primary outlet opening and the cut edge borders the secondary outlet opening. Such a configuration can be provided in the tool which manufactures the housing shell and this configuration is similar to the gill-like opening already mentioned above.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
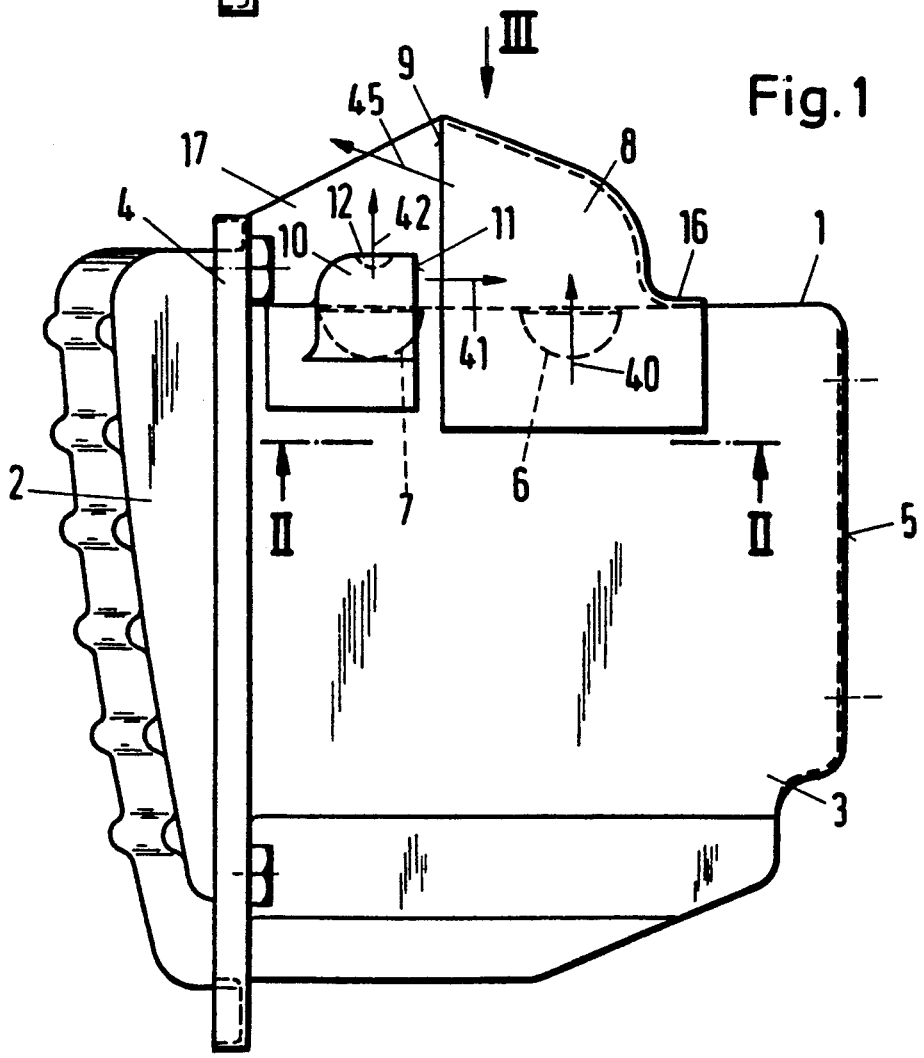
FIG. 1 is a plan view of the exhaust gas muffler according to the invention.

FIG. 1 shows an exhaust gas muffler 1 according to an embodiment of the invention. The muffler 1 comprises a first housing shell 2 and a second housing shell 3. The housing shells 2 and 3 are connected with each other at flange-like surfaces 4. The second housing shell 3 has an inlet opening 5 formed in the end face thereof for the exhaust gas. The housing shell 3 also has a lateral primary outlet opening 6 for the exhaust gas flow. The primary exhaust gas flow passes from the housing shell 3 through the opening 6 in the direction of a primary exit vector 40 and enters the interior of a guide hood 8 extending over the outlet opening 6. The exhaust gas flow flowing in the direction of the primary exit vector 40 is deflected within the guide hood 8 and exits into the ambient air via an outlet opening 9 facing toward the second housing shell 2. A secondary outlet opening 7 for a component exhaust gas flow lies in the same plane as the first primary outlet opening 6. The secondary outlet opening 7 is provided with a guide member which comprises a cap 10 in the embodiment shown.

The cap 10 covers the secondary outlet opening 7 and is open toward the guide hood 8 at its end 11 facing toward the primary outlet opening 6. The secondary exhaust gas flow exists from the exhaust gas chamber conjointly defined by the housing shells 2 and 3 through the secondary outlet opening 7 in the direction of exit vector 41. In this way, the secondary exhaust gas flow is directed into the region within the guide hood 8 and there crosses the primary exhaust gas flow exiting through the primary outlet opening 6 in the direction of primary exit vector 40. The vectors thereby conjointly define an angle which is preferably approximately 90°. The cross-over angle of the vectors can be varied in the range of 0° to 180° (antiparallel flow). It is important that the impinging secondary exhaust gas flow breaks up the primary exhaust gas flow and makes the latter turbulent. Because of this arrangement, the secondary exhaust gas flow exiting from the end 11 of the cap 10 breaks up the primary exhaust gas flow exiting from the first outlet opening 6 and thereby makes the primary gas flow very turbulent which, on the one hand, results in a considerable deceleration of the flow in the linear direction and, on the other hand, causes an intense mixing thereof with the ambient air.

In the embodiment shown, the cap 10 is provided with a third outlet opening 12 which has an exit vector 41 associated therewith. A further exhaust gas component flow passes through the third outlet opening 12 and flows approximately transversely toward the exhaust gas flow 45 of the exhaust gas flow leaving the hood 8 at the outlet opening 9 and causes the already turbulent flow to become more turbulent. This occurs after leaving the guide hood 8 whereby a still more intensive mixing with the ambient air and a significant reduction in temperature is obtained.

Figure 2:
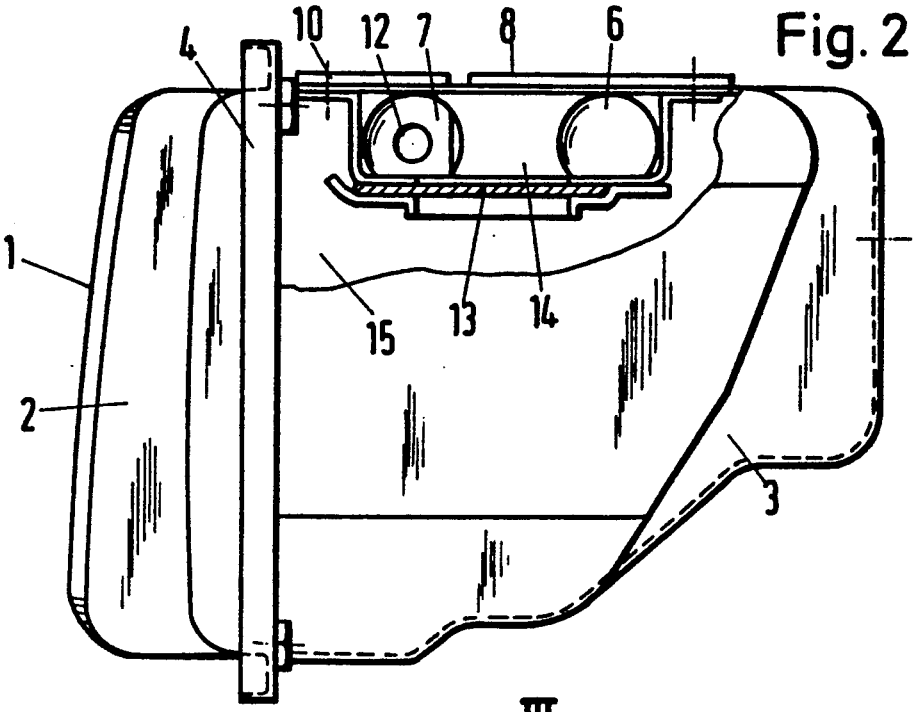
FIG. 2 is a side elevation view of the exhaust gas muffler of FIG. 1 with a portion of the wall thereof broken out to show the section view taken along line II—II of FIG. 1.

FIG. 2 shows that the exhaust gas muffler 1 has two outlet openings 6 and 7 for the exhaust gas which are approximately the same size. These outlet openings 6 and 7 are located laterally in the casing surface of the housing shell 3 in a component region 14 of the exhaust gas chamber 15 which is separated by means of a particle filter 13. The primary outlet opening 6 is straddled by the guide hood 8 and the cap 10 extends upwardly and arcuately over the secondary outlet opening 7. A third outlet opening 12 is formed in the cap 10 and has a substantially lower pass-through cross section compared to the outlet opening 7. The secondary outlet opening 7 lies ahead of the outlet opening 9 of the guide hood 8. The exit vector 41 of the secondary exhaust gas flow is directed into the hood. The open end 11 of cap 10 also lies ahead of the guide hood 8.

Figure 3:
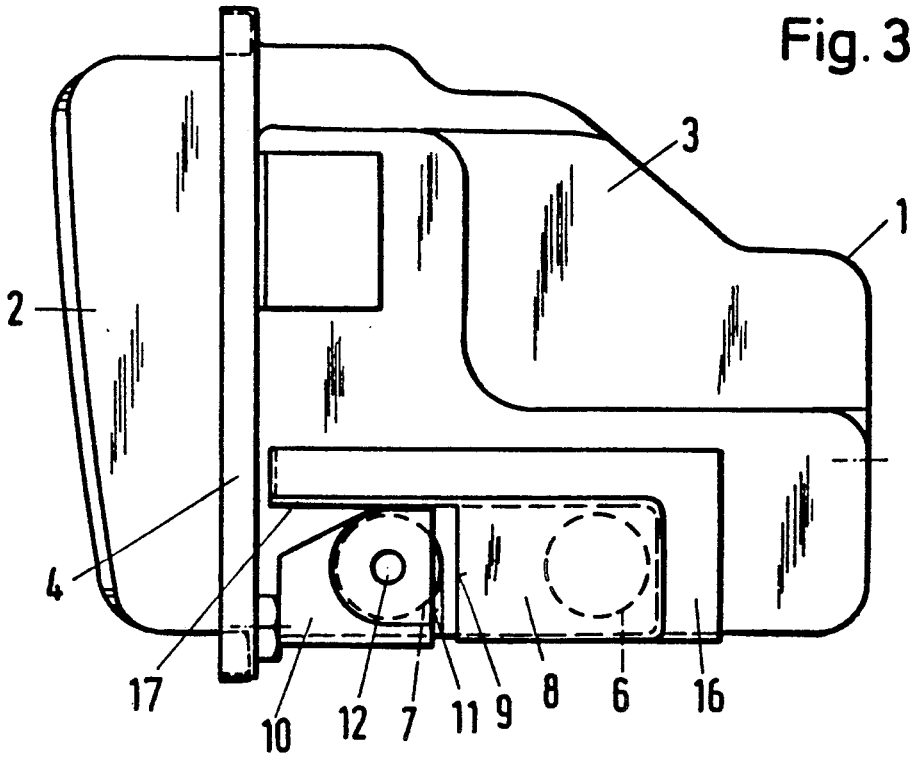
FIG. 3 is a side elevation view seen in a direction of arrow III of FIG. 1.

FIG. 3 shows a view taken in the direction of arrow III of FIG. 1. This view is of the exhaust gas muffler 1 in the direction toward the guide hood 8 and the cap 10. From this view, it can be seen that the guide hood 8 has a bent-over strip 16 for attachment to the housing shell 3. The strip 16 lies on the casing surface of the housing shell 3. The attachment of the guide hood 8 can, for example, be achieved by means of several spot welds in the region of the bent-over strip 16. A guide portion 17 extends from the guide hood 8 and is manufactured as a single piece with the hood 8. This guide portion 17 extends parallel to the exhaust gas outflow direction 45 of the exhaust gas flow.

In FIG. 3, the arrangement of the first and second outlet openings 6 and 7 is shown with broken lines since these are covered by the hood 8 and cap 10, respectively. The third outlet opening 12 can be seen in cap 10. Reference numeral 9 indicates the exit opening of the guide hood 8 and reference numeral 11 indicates the open end of cap 10.

Figure 5:
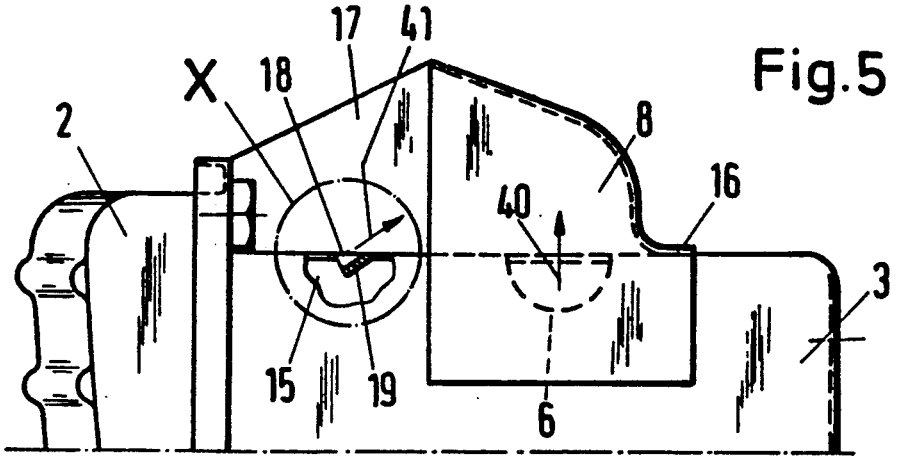
FIG. 5 is a plan view of the embodiment of the invention of FIG. 4 wherein a portion of the wall is broken out in the region of an outlet opening.
Figure 4:
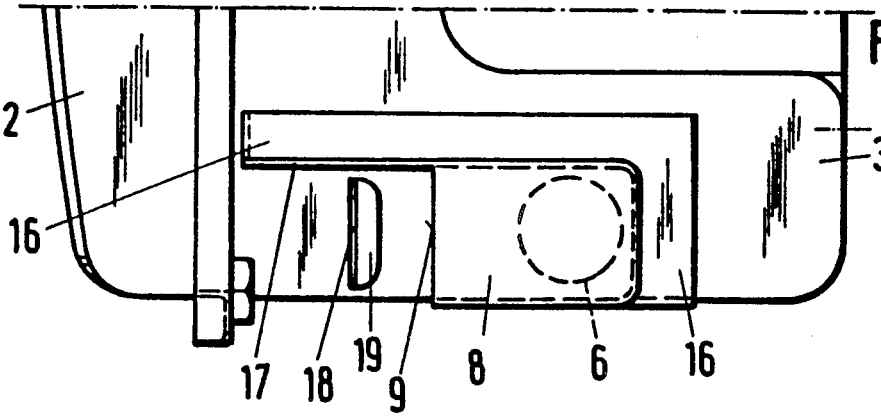
FIG. 4 is a partial view of another embodiment of the invention corresponding to the illustration seen in FIG. 3.

Another embodiment of the exhaust gas muffler according to the invention is shown in FIGS. 4 and 5. The embodiment of FIGS. 4 and 5 shows the arrangement of both housing shells 2 and 3 as well as the first primary outlet opening 6 with the guide hood 8 extending thereover and the guide portion 17 formed thereon.

Also shown in FIGS. 4 and 5 is the bent-over strip 16 for attaching the hood 8 and the guide element to the housing shell 3. The secondary outlet opening 18 is configured here as a slot extending transversely to the exhaust gas flow direction 45 of the exhaust gas. A gill-like opening 19 is provided as a guide element and is bent over inwardly into the exhaust gas chamber 15. This arrangement is provided for obtaining the necessary exit vector 40 of the secondary exit opening 18. The gill-like opening can be produced by means of a simultaneous shear and bend over operation. The secondary outlet opening 18 lies clearly ahead of the outlet opening 9 of the guide hood 8. A secondary outlet opening 18 formed in this way requires substantially less production effort than the configuration according to FIGS. 1 to 3. The form of the gill-like opening 19 extending along the longitudinal slot can be seen also from the partial detail view X of FIG. 5.

Figure 6:
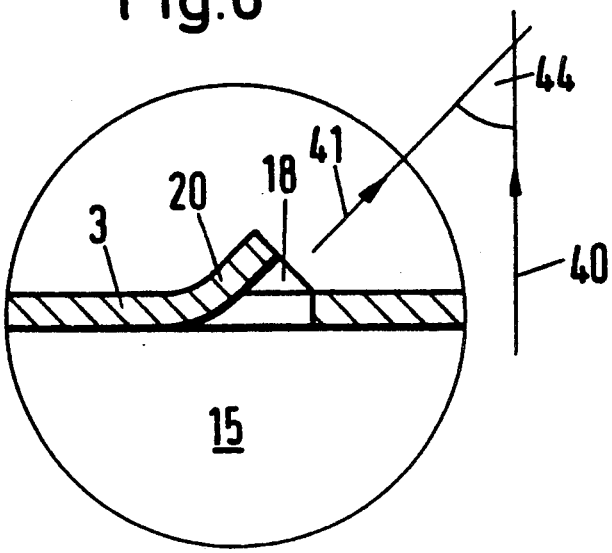
FIG. 6 is an enlarged view showing the detail within the circle X of FIG. 5.

FIG. 6 shows another variation of the gill-like opening according to the detail X in FIG. 5 and is an enlarged view. In this embodiment, the secondary outlet opening 18 is again configured as a slot. The guide element is again formed as a gill-like opening 10. However, and in contrast to the arrangement of FIG. 5, this gill-like opening 10 is not directed into the exhaust gas chamber 15 but is directed outwardly. With regard to manufacture, the gill-like opening 20 directed outwardly is as easy to produce as the gill-like opening 19 directed inwardly. An exit vector 41 is obtained by means of the gill-like opening and this exit vector 41 meets with the primary exit vector 40 at an angle 46 of approximately 45°.

Figure 7:
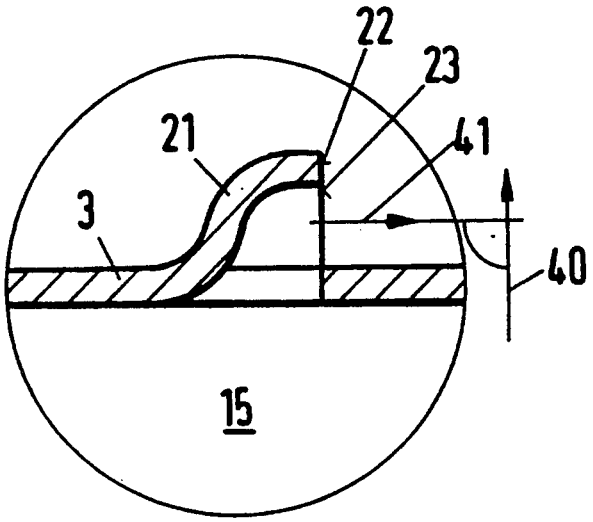
FIG. 7 is an alternate embodiment of the detail shown in the circle X of FIG. 5; and, FIG. 8 is still another embodiment in the form of a variation of that shown in FIG. 6 wherein a tubular piece is inserted into the wall of one of the housing shells.

FIG. 7 shows another variation of that shown in FIG. 6 where a cap 21 is again provided as a guide element for the component gas flow. However, and in contrast to the embodiment according to FIGS. 1 to 3, the cap 21 is not in the form of a separate component. To simplify manufacture, it is advantageous that the cap 21 be formed by means of a pressing of the housing shell 3 which is in the shape of a spherical segment. This cap 10 has a cut edge 22 on its side facing toward the guide hood by means of which the secondary exit opening 23 is defined for the secondary gas flow.

Figure 8:
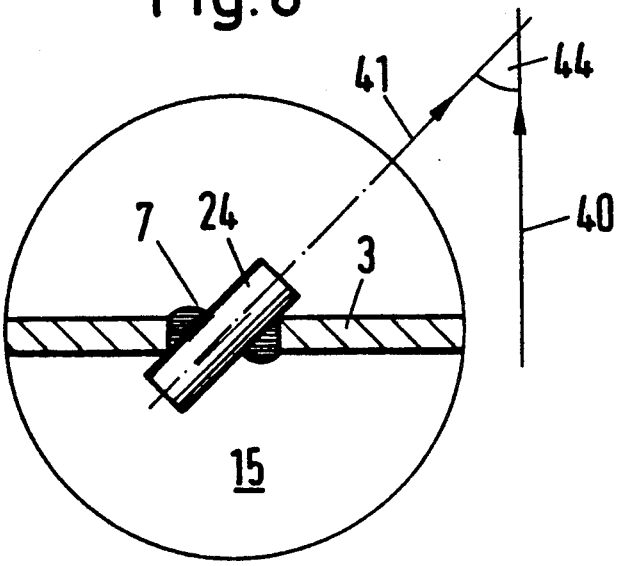

A further variation of detail X is shown in FIG. 8. In this embodiment, the secondary outlet opening 7 is provided in the housing shell 3 and a tubular piece 24 is welded into this opening 7. The tubular piece 24 is aligned at an angle with respect to the casing surface of the housing shell 3 and is welded into the latter. The angle corresponds to the desired exit vector 41 of the secondary exhaust gas flow. The angle 44 can be varied with respect to the guide hood 8 shown in FIGS. 1 to 5 in dependence upon the spacing of the secondary exit opening 7. In the illustrated embodiment, this angle is approximately 45° to the primary exit vector 40 of the primary exit opening.

All of the embodiments have in common that the vector 41 of the secondary exhaust gas flow is essentially transverse to the vector 40 of the primary gas flow. With the arrangement of a guide hood 8 over the primary outlet opening 6, the exit vector 41 can be positioned so that it is virtually opposed to the exhaust gas flow direction 45 from the guide hood 8. The exit vector is however essentially transverse when referred to the primary exit vector 40. The exit vector 42 of the third exhaust gas component flow is similarly positioned and exits from the cap 10 through the third outlet opening 12. The exit vector 42 is transverse to the exhaust gas outflow direction 45 referred to the primary exit vector 40 and is, however, directed parallelly and in the same direction to the latter.

It is understood that the foregoing description is that of the preferred embodiments of the invention and that various changes and modifications may be made thereto without departing from the spirit and scope of the invention as defined in the appended claims.

What is claimed is:

1. An exhaust gas muffler for an internal combustion engine such as a two-stroke engine for portable hand-held tools such as motor-driven chain saws, the engine including a cylinder and a piston conjointly defining a combustion chamber wherein combustion gases are generated and discharged as a flow of exhaust gas during operation of the engine, the exhaust gas muffler comprising:

a housing having a shell-like wall defining a chamber for receiving the exhaust gas from the engine;

said housing having a primary outlet opening formed in said wall for passing a primary component flow of said exhaust gas out of said chamber in a first direction;

said housing having a secondary outlet opening formed in said wall for passing a secondary component flow of said exhaust gas out of said chamber; said secondary outlet opening being disposed adjacent said primary outlet opening; and, guide means disposed at said secondary outlet opening for guiding said secondary component flow to flow in a second direction transverse to said first direction thereby causing said secondary component flow to break up said primary component flow and mix the latter with the ambient air.

2. The exhaust gas muffler of claim 1, said guide means comprising a cap extending over said secondary outlet opening and having an open end directed toward said primary outlet opening.

3. The exhaust gas muffler of claim 1, comprising ancillary outlet opening means for passing an additional flow of said exhaust gas in a third direction transverse to said second direction and toward said primary component flow to further break up the latter.

4. The exhaust gas muffler of claim 3, said secondary outlet opening having a secondary pass-through cross section and said ancillary outlet opening having an ancillary pass-through cross section less than said secondary pass-through cross section.

5. The exhaust gas muffler of claim 1, comprising a gill-like bent-over tab machine-formed from a portion of said wall of said housing to form said secondary outlet opening therein; and, said bent-over tab being bent with respect to the remainder of said wall to define said guide means.

6. The exhaust gas muffler of claim 1, said guide means being a tube piece seated in said secondary outlet opening for direction said secondary component flow toward said primary component flow in said second direction.

7. The exhaust gas muffler of claim 6, said tube piece being positioned in said secondary outlet opening so as to cause said second direction to define an angle of approximately 45° with said first direction.

8. The exhaust gas muffler of claim 1, said primary outlet opening and said secondary outlet opening having respective pass-through cross sections that are approximately equal.

9. The exhaust gas muffler of claim 1, said guide means being a cap machine-formed from a portion of said wall of said housing to form said secondary outlet opening therein; said portion being formed as a spherically-shaped segment having a cut edge defining said secondary outlet opening; and, said cap being positioned in said wall so as to cause said secondary outlet opening to face said primary outlet opening.

10. The exhaust gas muffler of claim 1, said housing including two shells conjointly defining a common interface; joining means for joining said shells at said interface; and, said primary outlet opening being formed in one of said shells.

11. An exhaust gas muffler for an internal combustion engine such as a two-stroke engine for portable hand-held tools such as motor-driven chain saws, the engine including a cylinder and a piston conjointly defining a combustion chamber wherein combustion gases are generated and discharged as a flow of exhaust gas during operation of the engine, the exhaust gas muffler comprising:

a housing having a shell-like wall defining a chamber for receiving the exhaust gas from the engine;

said housing having a primary outlet opening formed in said wall for passing a primary component flow of said exhaust gas out of said chamber in a first direction;

said housing having a secondary outlet opening formed in said wall for passing an additional flow of said exhaust gas out of said chamber;

a cap extending over said secondary outlet opening and having an open end directed toward said primary outlet opening for directing a first portion of said additional flow in a second direction transverse to said first direction so as to cause said first portion to break up said primary component flow; and, said cap having an ancillary opening formed therein for directing a second portion of said additional flow in a third direction transverse to said second direction and toward said primary component flow to further break up the latter.

12. The exhaust gas muffler of claim 11, said secondary outlet opening having a secondary pass-through cross section and said ancillary outlet opening having an ancillary pass-through cross section less than said secondary pass-through cross section.

13. An exhaust gas muffler for an internal combustion engine such as a two-stroke engine for portable hand-held tools such as motor-driven chain saws, the engine including a cylinder and a piston conjointly defining a combustion chamber wherein combustion gases are generated and discharged as a flow of exhaust gas during operation of the engine, the exhaust gas muffler comprising:

a housing having a shell-like wall defining a chamber for receiving the exhaust gas from the engine;

said housing having a primary outlet opening formed in said wall for passing a primary component flow of said exhaust gas out of said chamber in a first direction;

said housing having a secondary outlet opening formed in said wall for passing a secondary component flow of said exhaust gas out of said chamber in a second direction;

a guide hood disposed over said primary outlet opening and having a hood opening for directing said primary component flow into the ambient in a first direction;

said secondary outlet opening being disposed in front of said hood opening; and, guide means disposed at said secondary outlet opening for directing said secondary component flow toward and into said primary component flow to break up the latter to cause the same to become turbulent and mix with ambient air.

14. The exhaust gas muffler of claim 13, comprising ancillary outlet opening means for directing an additional flow of said exhaust gas in a third direction transverse to and into said primary component flow to further break up the latter.

* * * * *

UNITED STATES PATENT AND TRADEMARK OFFICE

CERTIFICATE OF CORRECTION

PATENT NO. : 5,315,075

DATED : May 24, 1994

INVENTOR(S) : Wolfgang Junginger, Matthias Rösler and Thomas Rupp

It is certified that error appears in the above-identified patent and that said Letters Patent is hereby corrected as shown below:

In column 1, line 41: between "and" and "piston" insert -- a --.

In column 1, line 59: delete "that" and substitute "the" therefor.

In column 2, line 50: delete "Fort his" and substitute "For this" therefor.

In column 6, line 19: delete "the latter" and substitute "said primary component flow" therefor.

In column 6, line 19: delete "the" (second occurrence).

In column 6, line 28: delete "the latter" and substitute -- said primary component flow -- therefor.

In column 6, line 38: delete "the" and substitute -- a -- therefor.

In column 6, line 42: delete "direction" and substitute -- directing -- therefor.

UNITED STATES PATENT AND TRADEMARK OFFICE

CERTIFICATE OF CORRECTION

PATENT NO. : 5,315,075

DATED : May 24, 1994

INVENTOR(S) : Wolfgang Junginger, Matthias Rösler and Thomas Rupp

It is certified that error appears in the above-identified patent and that said Letters Patent is hereby corrected as shown below:

In column 7, line 26: delete "the latter" and substitute "said primary component flow" therefor.

In column 8, line 19: delete "the".

In column 8, line 19: between "ambient" and "in" insert -- air --.

In column 8, line 26: delete "the latter" and substitute -- said primary component flow -- therefor.

In column 8, line 26: delete "same" and substitute "primary component flow" therefor.

In column 8, line 27: between "with" and "ambient" insert -- the --.

In column 8, line 32: delete "the latter" and substitute "said primary component flow" therefor.

Signed and Sealed this

Thirtieth Day of August, 1994

*Attest:*

*Attesting Officer*

Bruce Lehman

BRUCE LEHMAN

*Commissioner of Patents and Trademarks*